US009080233B2

(12) United States Patent
Suzuki et al.

(10) Patent No.: US 9,080,233 B2
(45) **Date of Patent: *Jul. 14, 2015**

(54) SPRING AND METHOD FOR PRODUCING SAME

(75) Inventors: Takeshi Suzuki, Yokohama (JP); Yoshiki Ono, Yokohama (JP); Shimpei Kurokawa, Yokohama (JP)

(73) Assignee: NHK SPRING CO., LTD., Yokohama (JP)

( * ) Notice: Subject to any disclaimer, the term of this patent is extended or adjusted under 35 U.S.C. 154(b) by 190 days.

This patent is subject to a terminal disclaimer.

(21) Appl. No.: 13/635,533

(22) PCT Filed: Mar. 23, 2011

(86) PCT No.: PCT/JP2011/056923

§ 371 (c)(1),
(2), (4) Date: Sep. 17, 2012

(87) PCT Pub. No.: WO2011/129179

PCT Pub. Date: Oct. 20, 2011

(65) Prior Publication Data

US 2013/0008566 A1 Jan. 10, 2013

(30) Foreign Application Priority Data

Apr. 14, 2010 (JP) ..... 2010-093543

(51) Int. Cl.

| | |
|---|---|
| ***C23C 8/26*** | (2006.01) |
| ***C23C 8/80*** | (2006.01) |
| ***C23C 8/32*** | (2006.01) |
| ***C21D 9/02*** | (2006.01) |
| ***C22C 38/02*** | (2006.01) |
| ***C22C 38/04*** | (2006.01) |
| ***C21D 7/06*** | (2006.01) |
| ***C21D 1/06*** | (2006.01) |
| ***C21D 1/25*** | (2006.01) |

(52) U.S. Cl.

CPC ... *C23C 8/32* (2013.01); *C21D 1/06* (2013.01); *C21D 1/25* (2013.01); *C21D 7/06* (2013.01); *C21D 9/02* (2013.01); *C22C 38/02* (2013.01); *C22C 38/04* (2013.01); *C23C 8/80* (2013.01); *C21D 2211/001* (2013.01); *C21D 2211/008* (2013.01)

(58) Field of Classification Search

CPC ..... C21D 9/02; C21D 7/06; C21D 1/25; C21D 2211/008; C22C 38/04

USPC ..... 148/225, 218, 318

See application file for complete search history.

(56) References Cited

U.S. PATENT DOCUMENTS

| | | | |
|---|---|---|---|
| 6,193,816 | B1 | 2/2001 | Nakano et al. |
| 2012/0318407 | A1 | 12/2012 | Suzuki et al. |

FOREIGN PATENT DOCUMENTS

| | | | |
|---|---|---|---|
| CN | 101665892 | A | 3/2010 |
| EP | 2 548 976 | A1 | 1/2013 |
| JP | A-58-193323 | | 11/1983 |
| JP | A-62-137133 | | 6/1987 |
| JP | A-6-158226 | | 6/1994 |
| JP | A-11-241143 | | 9/1999 |
| JP | B2-3028438 | | 4/2000 |
| JP | A-2003-170353 | | 6/2003 |
| JP | A-2005-139508 | | 6/2005 |
| JP | A-2007-46088 | | 2/2007 |
| JP | A-2009-52144 | | 3/2009 |
| WO | WO 2011/115255 | A1 | 9/2011 |

OTHER PUBLICATIONS

Lu Daxian, "An Analytical Probing of the New Technology for the Heat Treatment of Springs," *Materials for Mechanical Engineering*, Apr. 1996, pp. 41-43 and 54, vol. 20, No. 2, China Academic Journal Electronic Publishing House, China (with English Abstract).

Jan. 21, 2014 Office Action issued in Chinese Application No. CN 201180018770.3 (with translation).

Jun. 21, 2011 International Search Report issued in International Application No. PCT/JP2011/056923 (with translation).

Yuan et al., "Fatigue Performance of Leaf Spring Steel 38SiMnVB and Its Effect Factors," Automobile Technology & Material, Dec. 31, 2004, No. 6, pp. 96-99 (with Abstract).

Aug. 18, 2014 Office Action issued in Chinese Application No. 201180018770.3 (with translation).

Nov. 7, 2014 International Search Report issued in International Patent Application No. PCT/JP2011056923.

*Primary Examiner* — Jessee Roe

(74) *Attorney, Agent, or Firm* — Oliff PLC

(57) ABSTRACT

A spring consists of, by weight %, 0.27 to 0.48% of C, 0.01 to 2.2% of Si, 0.30 to 1.0% of Mn, not more than 0.035% of P, not more than 0.035% of S, and the balance of Fe and inevitable impurities. The spring has a nitrogen compound layer and a carbon compound layer at the surface at a total thickness of not more than 2 μm. The spring has a center portion with hardness of 500 to 700 HV in a cross section and has a compressive residual stress layer at a surface layer. The compressive residual stress layer has a thickness of 0.30 mm to D/4, in which D (mm) is a circle-equivalent diameter of the cross section, and has maximum compressive residual stress of 1400 to 2000 MPa.

10 Claims, No Drawings

SPRING AND METHOD FOR PRODUCING SAME

TECHNICAL FIELD

The present invention relates to a spring and to a production method therefor, and specifically relates to a technique for forming a layer with high compressive residual stress from a surface to deep inside the spring.

BACKGROUND ART

Since there is a trend of reducing dimensions and weight in automobile valve springs, in order to reduce the diameter of a spring wire while increasing design stress, a necessary degree of strength of the spring wire has been increasing. In this regard, in springs, further improvement of fatigue strength is required for having sufficient fatigue resistance even when high stress is applied to the springs. As one of the means for satisfying this requirement, high compressive residual stress may be provided from a surface to deep inside of a surface layer of a spring wire. Conventionally, in springs, the compressive residual stress is generally provided to a surface layer of the spring wire by shot peening. However, since the amount of plastic strain at the surface layer is decreased according to increase of the hardness of the spring wire in recent years, a thick compressive residual stress layer is difficult to obtain.

By increasing the compressive residual stress at the outermost surface layer by conventional shot peening, breakage originating from the surface at an early time may be prevented. On the other hand, according to the increase in design stress in recent years, combined stress of applied stress and residual stress (net stress applied to an inside of a spring wire) reaches a maximum at around a depth of 200 to 600 μm from the surface. This depth from the surface in a radial direction depends on the diameter of the spring wire, the degree of the applied stress, and the like. If inclusions with sizes of approximately 20 μm exist within this area, stress concentrates on the inclusions. The concentrated stress may exceed the fatigue strength of the spring wire and make the inclusions starting points of breakage. Accordingly, the following techniques were disclosed in order to solve these problems.

A spring with high durability is disclosed in Japanese Unexamined Patent Application Laid-open No. 2009-52144. This spring is subjected to shot peening after gas nitriding, whereby it has a nitrided layer that has a surface portion with compressive residual stress of not less than 1200 MPa. The compressive residual stress is provided from the surface to not less than 250 μm depth. As disclosed in the Examples, the compressive residual stress is provided from the surface to 290 μm depth at most in this spring. Therefore, it is difficult to prevent breakage originating from an area that is deeper than 290 μm. Moreover, since the nitrided layer has little ductility and is brittle, the nitrided layer may facilitate formation of fatigue cracks and cause a decrease in fatigue strength.

A spring with superior fatigue strength is disclosed in Japanese Patent No. 3028438. In this spring, compressive residual stress of 90±10 kgf/mm$^2$ is provided from the surface layer to 150 μm depth. According to the fatigue test disclosed in Japanese Patent No. 3028438, the condition of shear stress was $\tau$=65±50 kgf/mm$^2$. The shear stress is small compared with practical stress conditions (for example, $\tau$=78±73 kgf/mm$^2$) for lightweight and high strength valve springs of recent years.

Another spring with superior fatigue strength is disclosed in Japanese Unexamined Patent Application Laid-open No. 2005-139508. This spring is subjected to shot peening after a nitriding treatment, and it is provided with surface compressive residual stress of not less than 1600 MPa. It is insufficient to greatly improve the fatigue strength only by specifying the degree of the surface compressive residual stress. Preventing internal fractures due to inclusions is rather important, but descriptions relating to compressive residual stress inside the spring are not disclosed.

A spring steel with superior fatigue characteristics is disclosed in Japanese Unexamined Patent Application Laid-open No. 6-158226. The spring steel includes oxide inclusions composed of, by weight %, 30 to 60% of $SiO_2$, 10 to 30% of $Al_2O_3$, 10 to 30% of CaO, and 3 to 15% of MgO, and the oxide inclusions have circle-equivalent diameters of not more than 15 μm. However, it is difficult to precisely control the compositions and the grain sizes of the oxide inclusions to be in the above range. In this regard, it is necessary to inspect whether the amounts of the oxide inclusions in produced spring steels are in the above range. In spring steels other than spring steels that are inspected, even if they are of the same lot, the amounts of the oxide inclusions may be out of the above range. In this case, a spring made of the spring steel has a potential of break early due to the oxide inclusions.

Another spring is disclosed in Japanese Unexamined Patent Application Laid-open No. 2003-170353. This spring is subjected to shot peening using amorphous particles as a projection material after a nitriding treatment, and it is provided with maximum compressive residual stress of not less than 1600 MPa. According to the Example disclosed in Japanese Unexamined Patent Application Laid-open No. 2003-170353, the maximum compressive residual stress at the surface of the spring was approximately 2500 MPa. In this case, descriptions relating to a compressive residual stress distribution in depth direction are not disclosed. Estimating from the accompanying FIGURE in the Example, the compressive residual stress was provided from the surface to approximately 250 μm depth. Therefore, it is difficult to prevent internal fractures originating from an area that is deeper than 250 μm.

A carbonitrided quenched material and a production method therefor are disclosed in Japanese Unexamined Patent Application Laid-open No. 2007-46088. The carbonitrided quenched material has a surface layer without nitrogen compounds and has a nitrogen diffused layer from the surface to a predetermined depth where nitrogen is solid solved. In addition, the carbonitrided quenched material is subjected to a quenching treatment. According to this technique, brittle nitrogen compounds that can become starting points of breakage are not formed after nitrogen is absorbed, and the surface layer has high hardness, whereby the fatigue strength may be improved. However, in the invention disclosed in Japanese Unexamined Patent Application Laid-open No. 2007-46088, compressive residual stress is not described, and a high hardness layer at the surface had a thickness of approximately 60 μm at most. Therefore, the fatigue strength cannot be greatly improved only by the technique disclosed in Japanese Unexamined Patent Application Laid-open No. 2007-46088. In addition, according to the production conditions disclosed in Japanese Unexamined Patent Application Laid-open No. 2007-46088, the carbonitriding temperature was low. As a result, the concentration of nitrogen at the surface was low, and a concentrated layer was thin.

DISCLOSURE OF THE INVENTION

Accordingly, the present invention has been completed in view of these circumstances, and an object of the present invention is to provide a spring and a production method therefor. In the spring, thicknesses of a nitrogen compound layer and a carbon compound layer at a surface layer are minimized, and a layer with high compressive residual stress is thickly formed at the surface layer, whereby the fatigue strength is greatly improved.

The inventors of the present invention conducted intensive research on a compressive residual stress distribution that affects the fatigue strength of a high strength spring. As a result, the inventors of the present invention found the following. That is, the fatigue strength is not further increased with respect to stress applied by external load, even by increasing compressive residual stress at a surface layer portion to be not less than a predetermined degree. In addition, providing compressive residual stress from the surface to not less than 300 μm depth is very effective for preventing fatigue failure that originates from the inside of a spring. Then, the inventors of the present invention reached a conclusion that high hardness and a layer with high compressive residual stress are efficiently obtained by the following method. In this method, a carbonitriding is performed at a higher temperature than that in the technique disclosed in Japanese Unexamined Patent Application Laid-open No. 2007-46088. As a result, a thick layer containing nitrogen and carbon at high concentrations is formed on the surface of a spring wire, whereby residual austenite is positively generated. Then, by performing shot peening or the like, deformation-induced martensite transformation (with volume expansion) is generated in the residual austenite.

The present invention provides a spring that has been completed based on the above finding, and the spring consists of, by weight %, 0.27 to 0.48% of C, 0.01 to 2.2% of Si, 0.30 to 1.0% of Mn, not more than 0.035% of P, not more than 0.035% of S, and the balance of Fe and inevitable impurities. The spring has a nitrogen compound layer and a carbon compound layer at a total thickness of not more than 2 μm at a surface thereof. The spring has a center portion with hardness of 500 to 700 HV in a cross section and has a compressive residual stress layer at a surface layer. The compressive residual stress layer has a thickness of 0.30 mm to D/4, in which D (mm) is a circle-equivalent diameter of the cross section, and has maximum compressive residual stress of 1400 to 2000 MPa. The cross section of the spring preferably has a circle-equivalent diameter of 1.5 to 5.0 mm. It should be noted that the "cross section" is a cross section that orthogonally crosses a longitudinal direction of the spring.

The present invention also provides a production method for a spring, by which the above spring is produced. The method includes a step of preparing a steel material consisting of, by weight %, 0.27 to 0.48% of C, 0.01 to 2.2% of Si, 0.30 to 1.0% of Mn, not more than 0.035% of P, not more than 0.035% of S, and the balance of Fe and inevitable impurities. The method also includes a chemical surface treatment step of heating the steel material and bringing the steel material into contact with a mixed gas atmosphere so as to concentrate nitrogen and carbon at a surface layer thereof. In this case, the steel material is heated at a temperature of not less than the $A_3$ point of the steel material and not more than 1100° C. The mixed gas atmosphere consists of 50 to 90 vol. % of $NH_3$ and the balance of inert gas and inevitable impurities. The method further includes a step of quenching the steel material to room temperature at a rate of not less than 20° C./second, a step of tempering the steel material at a temperature of 100 to 200° C., and a step of providing compressive residual stress on the surface layer.

The grounds of limiting the above numerical values and the functions of the present invention will be described hereinafter. First, the reason for limiting the chemical composition of the steel used in the present invention will be described. It should be noted that the symbol "%" represents "weight %" in the following descriptions.

C: 0.27 to 0.48%

C is necessary for obtaining strength of the steel, which is sufficient for bearing a load and is necessary for a spring, by the quenching and the tempering. In general, the hardness of a steel material tends to be increased with the increase of the concentration of C. Therefore, in order to obtain a center portion with not less than 500 HV in the steel material after the tempering even at 400° C. in the surface treatment method of the present invention, the concentration of C must be not less than 0.27%. On the other hand, if the concentration of C is excessive, the hardness of the center portion exceeds 700 HV after the quenching, and the toughness is greatly decreased. In this case, the hardness of the center portion can be decreased by tempering at high temperature of greater than 400° C. However, at the same time, nitrogen compounds and carbon compounds are generated in a nitrogen solid-solved layer and a carbon solid-solved layer. Accordingly, in order to obtain a center portion with hardness of not more than 700 HV in the steel material by performing a tempering even at a low temperature so as to not generate the nitrogen compounds and the carbon compounds, the concentration of C is set to be not more than 0.48%.

Si: 0.01 to 2.2%

Si is a deoxidizing element that is effective in steel refining, and it is necessary to add Si at not less than 0.01%. In addition, Si is a solid-solution strengthening element and is effective for obtaining high strength. If the concentration of Si is excessive, workability is decreased. Therefore, the concentration of Si is set to be not more than 2.2%.

Mn: 0.30 to 1.0%

Mn is added as a deoxidizing element. Mn has a solid-solution strengthening effect and improves quenchability, and therefore, Mn is added at not less than 0.30%. On the other hand, if the concentration of Mn is excessive, segregation occurs, and workability tends to be decreased. Therefore, the concentration of Mn is set to be not more than 1.0%.

P: not more than 0.035%, S: not more than 0.035%

P and S facilitate grain-boundary fracture by grain-boundary segregation. Therefore, the concentrations of P and S are desirably lower, and the upper limits thereof are set to be 0.035%. The concentrations of P and S are preferably not more than 0.01%.

Then, the reason for limiting physical characteristics of the spring of the present invention will be described hereinafter.

Total Thickness of Nitrogen Compound Layer and Carbon Compound Layer at Surface

The nitrogen compounds and the carbon compounds are brittle and have low toughness, and thereby facilitate generation of cracks if they are formed on the surface of the steel material. Therefore, although some amounts of the nitrogen compounds and the carbon compounds are allowable, the upper limit of the total thickness thereof is 2 μm, and preferably, not more than 1 μm.

Hardness of Center Portion of Spring

The hardness of the center portion of the spring is required to be not less than 500 HV in order to obtain strength which is sufficient for bearing a load and which is necessary for the spring. On the other hand, if the hardness is too high, notch sensitivity of the steel material is increased, whereby the fatigue strength is decreased. Therefore, the hardness of the center portion of the spring is set to be not more than 700 HV.

Compressive Residual Stress Distribution at Surface Layer

The maximum value of the compressive residual stress at the surface layer is 1400 to 2000 MPa, and the compressive residual stress layer has a thickness of 0.30 mm to D/4. The thickness of the compressive residual stress layer is a distance from the surface to a position where the compressive residual stress is zero, which is hereinafter called "thickness". In order to prevent generation and growth of fatigue cracks, the compressive residual stress layer at the surface layer desirably has larger maximum compressive residual stress and desirably has a greater thickness. However, if the maximum compressive residual stress at the surface layer is too high, or the compressive residual stress layer is too thick, tensile residual stress inside the steel material is greatly increased because the residual stress is balanced in the entirety of the steel material. The tensile residual stress facilitates the generation of cracks in conjunction with tensile stress which is generated hi the spring wire by external load. Therefore, it is desirable that the thickness of the compressive residual stress layer be D/4 when the maximum compressive residual stress is 1400 MPa and is 0.30 mm when the maximum compressive residual stress is 2000 MPa.

In addition, the compressive residual stress at a position of 300 μm depth from the surface is desirably 100 to 300 MPa. In a mode of applying high stress, for example, maximum shear stress $\tau$=1470 MPa, it is assumed that a spring wire has a diameter of 5 mm and an average diameter of the coil is not less than 15 mm. In this case, if the compressive residual stress at the position of 300 μm depth is less than 100 MPa, the combined stress of the applied stress and the compressive residual stress exceeds 1100 MPa. The combined stress is more likely to exceed the fatigue limit, which is estimated from the hardness of the spring wire. Therefore, in this case, the compressive residual stress is insufficient for preventing internal fractures. In contrast, if the compressive residual stress at the position of 300 μm depth from the surface exceeds 300 MPa, the tensile residual stress inside the steel material is too high, whereby the fatigue strength is decreased.

Next, a production method for the spring of the present invention will be described. The spring of the present invention is produced by performing a chemical surface treatment step, a quenching step, a tempering step, and a step of providing compressive residual stress to a surface layer of the steel material, in that order. In the chemical surface treatment step, the steel material having the above chemical composition is heated to a temperature of not less than the $A_3$ point of the steel and not more than 1100° C. Then, the steel material is brought into contact with a mixed gas atmosphere so as to concentrate nitrogen and carbon at a surface layer of the steel material. The mixed gas atmosphere consists of 50 to 90 vol. % of $NH_3$ and the balance of inert gas and inevitable impurities. The quenching step is performed by cooling the steel material to room temperature at a rate of not less than 20° C./second. The tempering step is performed by heating the steel material at a temperature of 100 to 200° C. Although the structure of the steel before the heating at not less than the $A_3$ point is not particularly limited, prior austenite grain size is preferably smaller, and an average grain size is desirably not more than 30 μm. For example, a hot forged bar steel material or a drawn wire steel material may be used as a raw material. The reasons for the limitations in each step will be described hereinafter.

Chemical Surface Treatment Step

In the chemical surface treatment step, a compressive residual stress layer with a thickness of 0.30 mm to D/4 is formed by adsorbing nitrogen and carbon into the steel material, and austenite is positively made to remain. Thus, a predetermined amount of residual austenite is formed after the tempering, whereby a layer with higher compressive residual stress is formed in the step of providing compressive residual stress, which will be described later. In the following descriptions, the compressive residual stress layer obtained after the step of providing compressive residual stress is called a "high compressive residual stress layer". For the same reason as in an ordinary quenching treatment, first, the steel material is heated to be not less than the $A_3$ point. In this case, if the heating temperature is too high, $NH_3$ gas is decomposed immediately after it is introduced, and absorption of nitrogen and carbon into the steel material is greatly decreased. Therefore, the upper limit of the heating temperature is set to be 1100° C. The heating temperature is desirably 850 to 1000° C. The function of absorption of the carbon will be described later. The heating time is desirably 15 to 110 minutes. If the heating time is less than 15 minutes, the absorbed amounts of nitrogen and carbon are small, whereby residual austenite is insufficiently generated. As a result, a necessary high compressive residual stress layer is difficult to obtain in the step of providing compressive residual stress. On the other hand, if the heating time is greater than 110 minutes, brittle nitrogen compounds and carbon compounds are easily formed at a total thickness of more than 2 μm at the surface layer, which facilitate generation of cracks. The heating time is based on a condition in which the gas for the chemical surface treatment is at approximately 1 atmosphere that includes industrially controllable error. In a treatment under a reduced-gas atmosphere or a pressurized gas atmosphere, the heating time is desirably adjusted inversely with the gas pressure.

In order to concentrate nitrogen and carbon at the surface layer, the steel material is brought into contact with a mixed gas. The mixed gas is supplied at an amount so that nitrogen is sufficiently absorbed into the steel material at least at an amount which is calculated from the concentration of nitrogen described in the present invention. The mixed gas contains 50 to 90 vol. % of $NH_3$ at the standard condition (1 atmosphere, 20° C.). If the concentration of $NH_3$ is less than 50 vol. % in the mixed gas atmosphere, the absorbed amounts of nitrogen and carbon are small, whereby a necessary high compressive residual stress layer is not obtained. On the other hand, if the concentration of $NH_3$ is greater than 90 vol. %, the ratio of the residual austenite at the surface layer is excessively increased, whereby high compressive residual stress is not obtained. The concentration of $NH_3$ is preferably 80 to 90 vol. %. This function will be described in detail in the following sections of "Ratio of Residual Austenite" and "Concentrations of Nitrogen and Carbon".

As described above, in the chemical surface treatment step, the heating temperature, the heating time, and the composition of the mixed gas at the standard condition, are important parameters for controlling absorption of nitrogen and carbon into the surface of the steel material. Thus, nitrogen and carbon are rapidly diffused to the inside of the steel material, thereby preventing generation of the nitrogen compounds and the carbon compounds at the surface layer. Moreover, a thick high compressive residual stress layer is formed after the step of providing compressive residual stress.

The function of concentrating carbon at the surface layer of the steel material by bringing the steel material into contact with the mixed gas of $NH_3$ and the inert gas will be described hereinafter. The inventors of the present invention investigated distribution conditions of carbon inside a steel material and found that the amount of carbon inside the steel material did not change before and after the chemical surface treatment. Therefore, it is expected that the carbon concentrated at the surface layer was not the carbon which moved from the inside of the steel material. Although the reason for the concentrating of carbon at the surface layer is not clear, it may be supposed to be as follows. That is, $NH_3$ on the surface of the steel is decomposed into atoms of nitrogen and hydrogen by Fe as a catalyst under the above conditions. The atom of nitrogen is expected to be in a radical condition having unpaired electrons. The nitrogen radical remains in the radical condition for some reason even when it is absorbed and is solid solved in the steel. Therefore, in an analysis using an Electron Probe Microanalyzer (EPMA-1600 manufactured by Shimadzu Corporation), there is a possibility that the wavelength of characteristic X-rays of nitrogen is changed and the radical nitrogen is detected as carbon. The Electron Probe Microanalyzer was used in an element analysis in the "Best Mode for Carrying Out the Invention".

Quenching Step

In the quenching step after the chemical surface treatment, the cooling to room temperature is preferably faster. The quenching step must be performed at a cooling rate of not less than 20° C./second. If the cooling rate is less than 20° C./second, pearlite is generated during the cooling, and the quenching is not completely performed, whereby a predetermined hardness is not obtained. The cooling to room temperature is preferably performed at not less than 50° C./second.

Tempering Step

After the quenching step, the center portion of the steel material has a martensite structure. This martensite structure includes strain, which is generated by the quenching, and thereby easily causes failure such as delayed cracks. Moreover, this martensite structure has extremely low toughness and has a possibility of causing breakage under low applied stress. Therefore, tempering is performed. The tempering must be performed at not less than 100° C. so as to decrease the strain at the center portion of the steel material. On the other hand, if the tempering temperature exceeds 200° C., the hardness of the center portion of the steel material is decreased, whereby the steel material cannot bear a load when used as a spring.

Step of Providing Compressive Residual Stress

The thick high compressive residual stress layer at the surface layer is obtained by utilizing deformation-induced martensite transformation (with volume expansion) of the residual austenite. The deformation is preferably performed by shot peening in consideration of productivity in practical production and economic limitations. As shot used in the shot peening, cut wire, steel balls, or the like, may be used. The degree of the compressive residual stress can be adjusted by a sphere-equivalent diameter of the shot, injecting speed, injecting time, and a multistep injecting process. The sphere-equivalent diameter of the shot is desirably 0.7 to 1.3 mm. If the diameter of the shot is less than 0.7 mm, collision energy is not sufficiently obtained by the injected shot. In this case, plastic strain at the surface layer of the spring wire is small, whereby a predetermined compressive residual stress distribution is difficult to obtain. If the diameter of the shot is too large, the surface roughness of the spring wire is increased, which easily causes breakage that originates from the surface at an early time. Therefore, the diameter of the shot is desirably not more than 1.3 mm. In addition, when the hardness of the shot is higher than the center portion of the steel material, the shot peening is efficiently performed. Accordingly, the shot preferably has a Vickers hardness of not less than 600 HV.

Ratio of Residual Austenite

After the tempering step but before the step of providing compressive residual stress, the spring wire desirably contains residual austenite from the surface to 100 μm depth in cross section at an average ratio of 10 to 35 vol. %. When residual austenite is induced by plastic deformation, it is transformed into martensite. Simultaneously, the residual austenite expands in volume. Therefore, by making the residual austenite to remain at the surface layer of the spring wire after the tempering step, a thick high compressive residual stress layer is formed at the surface layer in the subsequent step of providing compressive residual stress. If the ratio of the residual austenite is less than 10%, the amount of the volume expansion due to the deformation-induced martensite transformation is small. In this case, a predetermined compressive residual stress distribution is difficult to obtain.

On the other hand, according to the increase in the concentrations of nitrogen and carbon in the residual austenite, the stability of the residual austenite with respect to external force is increased. Therefore, it is difficult for the deformation-induced martensite transformation to occur. In a case in which the ratio of the residual austenite exceeds 35%, the concentrations of nitrogen and carbon are greater than acceptable values. As a result, a predetermined compressive residual stress distribution is difficult to obtain. The ratio of the residual austenite is limited from the surface to 100 μm depth because the degree of processing in the step of providing compressive residual stress is the greatest at the surface and decreases with depth. The processing at a degree, by which the residual austenite is transformed into martensite, is substantially performed in the range of from the surface to approximately 100 μm depth. The martensite transformation (with volume expansion) of the residual austenite in this range provides compressive residual stress to a deeper inside area. Accordingly, the ratio of the residual austenite from the surface to 100 μm depth is an important parameter for obtaining a predetermined compressive residual stress distribution.

Concentrations of Nitrogen and Carbon

After the tempering step but before the step of providing compressive residual stress, the total concentration of nitrogen and carbon from the surface to 100 μm depth in a cross section of the spring wire is desirably 0.8 to 1.2 weight %. If the total concentration of nitrogen and carbon is less than 0.8 weight %, not less than 10% of the ratio of the residual austenite is difficult to obtain. On the other hand, if the total concentration of nitrogen and carbon exceeds 1.2 weight %, as described above, the residual austenite is stabilized, and a predetermined compressive residual stress distribution is not obtained. The concentrations of nitrogen and carbon are limited in the range of from the surface to 100 μm depth because the total concentration of these elements is closely related to the generation ratio of the residual austenite as describe above.

Effects of the Invention

According to the present invention, while the total thickness of the nitrogen compound layer and the carbon compound layer on the surface layer is minimized, a thick high compressive residual stress layer is formed at the surface layer. Accordingly, the fatigue strength is further improved.

BEST MODE FOR CARRYING OUT THE INVENTION

A round bar steel material which had a typical chemical composition shown in Table 1 and had a diameter of 4 mm was prepared. The round bar steel material was subjected to the chemical surface treatment under the conditions shown in Table 2. In this case, in order to sufficiently austenitize, the round bar steel material was maintained at 860° C. for 15 minutes in a second treatment. Then, the round bar steel material was quenched by cooling to room temperature at a rate of not less than 20° C./second and was tempered for 60 minutes. Next, the tempered round bar steel material was subjected to shot peening. In the shot peening, round cut wires (630 HV) with a sphere-equivalent diameter of 0.8 mm were used in a first step. Then, round cut wires (630 HV) with a sphere-equivalent diameter of 0.45 mm, and particles of sand with a sphere-equivalent diameter of 0.1 mm, were used in a second step and a third step, respectively.

TABLE 1

| | Typical chemical composition (mass %) The balance is iron and inevitable impurities | | | | | | |
|---|---|---|---|---|---|---|---|
| Steel type | C | Si | Mn | Cr | P | S | $A_3$(° C.) |
| S35C | 0.32 | 0.23 | 0.81 | Tr. | 0.01 | 0.01 | 797 |

ing to them. The total thickness of the nitrogen compounds and the carbon compounds was measured from element distributions of nitrogen and carbon, which were obtained by using an Electron Probe Microanalyzer (EPMA).

(2) Average Hardness at Center Portion

Vickers hardness was measured at a position of 0, 0.1, and 0.2 mm from the center of the steel material in a cross section, and an average thereof was calculated.

(3) Residual Stress Distribution and Residual Austenite Distribution

Each of residual stress and residual austenite was measured with respect to an outer circumferential surface of the steel material by an X-ray diffraction method. Then, after the entire surface of the steel material was chemically polished, the above measurement was performed again. By repeating these steps, distributions of residual stress and residual austenite in a depth direction were obtained.

(4) Concentrations of Nitrogen and Carbon

TABLE 2

| | Chemical surface treatment | | | | | | Thickness of | | | |
|---|---|---|---|---|---|---|---|---|---|---|
| No. | Concentration of $NH_3$ in atmosphere gas (vol. %) | Temperature in first treatment (° C.) | Time in first treatment (minutes) | Temperature in second treatment (° C.) | Time in second treatment (minutes) | Tempering temperature (° C.) | nitrogen compounds and carbon compounds at surface layer (μm) | Hardness at center portion (HV) | Maximum compressive residual stress (MPa) |
| 1 | 93 | 800 | 105 | 860 | 15 | 200 | 0 | 593 | 1278 |
| 2 | 93 | 800 | 45 | 860 | 15 | 200 | 0 | 579 | 1285 |
| 3 | 93 | 800 | 20 | 860 | 15 | 200 | 0 | 580 | 1274 |
| 4 | 88 | 800 | 105 | 860 | 15 | 200 | 0 | 585 | 1519 |
| 5 | 78 | 800 | 105 | 860 | 15 | 200 | 0 | 591 | 1546 |
| 6 | 88 | 800 | 45 | 860 | 15 | 200 | 0 | 582 | 1527 |
| 7 | 78 | 800 | 45 | 860 | 15 | 200 | 0 | 592 | 1519 |
| 8 | 88 | 800 | 20 | 860 | 15 | 200 | 0 | 586 | 1542 |
| 9 | 78 | 800 | 20 | 860 | 15 | 200 | 0 | 578 | 1592 |
| 10 | 88 | 1200 | 83 | Not performed | Not performed | 200 | 0 | 520 | 1125 |
| 11 | 0 | 800 | 105 | 860 | 15 | 200 | 0 | 527 | 1038 |

| No. | Thickness of compressive residual stress layer (mm) | Compressive residual stress at 300 μm depth from surface (MPa) | Average ratio of residual austenite from surface to 100 μm depth before step of providing compressive residual stress (vol. %) | Average element concentration from surface to 100 μm depth before step of providing compressive residual stress (wt %) Nitrogen | Carbon | Total of nitrogen and carbon | Notes |
|---|---|---|---|---|---|---|---|
| 1 | 0.43 | 175 | 56.2 | 0.81 | 0.50 | 1.31 | Comparative example |
| 2 | 0.42 | 34 | 52.0 | 0.74 | 0.48 | 1.22 | Comparative example |
| 3 | 0.37 | 80 | 38.7 | 0.73 | 0.48 | 1.21 | Comparative example |
| 4 | 0.43 | 80 | 31.6 | 0.60 | 0.49 | 1.09 | Practical example |
| 5 | 0.42 | 192 | 20.5 | 0.48 | 0.42 | 0.90 | Practical example |
| 6 | 0.34 | 83 | 27.0 | 0.57 | 0.48 | 1.05 | Practical example |
| 7 | 0.35 | 80 | 15.5 | 0.51 | 0.36 | 0.87 | Practical example |
| 8 | 0.36 | 137 | 26.4 | 0.48 | 0.42 | 0.90 | Practical example |
| 9 | 0.33 | 32 | 16.8 | 0.48 | 0.37 | 0.85 | Practical example |
| 10 | 0.24 | Tensile stress 122 | 6.1 | 0.42 | 0.18 | 0.60 | Comparative example |
| 11 | 0.18 | Tensile stress 118 | 1.7 | 0.32 | 0 | 0.32 | Comparative example |

Thus, steel materials were obtained, and various characteristics were investigated in the following manner. The results are also shown in Table 2. In Table 2, the underline indicates that the value does not satisfy the condition described in the present invention.

(1) Total Thickness of Nitrogen Compounds and Carbon Compounds at Surface Layer

An X-ray diffraction profile was measured with respect to an outer circumferential side surface of the round bar steel. Then, generation of nitrogen compounds and carbon compounds was determined from existence of peaks corresponding to them. The total thickness of the nitrogen compounds and the carbon compounds was measured from element distributions of nitrogen and carbon, which were obtained by using an Electron Probe Microanalyzer (EPMA).

(2) Average Hardness at Center Portion

Vickers hardness was measured at a position of 0, 0.1, and 0.2 mm from the center of the steel material in a cross section, and an average thereof was calculated.

(3) Residual Stress Distribution and Residual Austenite Distribution

Each of residual stress and residual austenite was measured with respect to an outer circumferential surface of the steel material by an X-ray diffraction method. Then, after the entire surface of the steel material was chemically polished, the above measurement was performed again. By repeating these steps, distributions of residual stress and residual austenite in a depth direction were obtained.

(4) Concentrations of Nitrogen and Carbon

Concentrations of nitrogen and carbon from the surface to 100 μm depth were measured with respect to a cross section of the round bar by using the Electron Probe Microanalyzer (EPMA) described above.

(5) Results

The practical examples of the samples Nos. 4 to 9 satisfied all of the production conditions described in the present invention. These practical examples did not have the nitrogen compound layer and the carbon compound layer at the surface and had a thick high compressive residual stress layer at the surface layer. In contrast, in the comparative examples of the samples Nos. 1 to 3, the concentration of $NH_3$ in the atmosphere gas was high in the chemical surface treatment step. Therefore, the concentrations of nitrogen and carbon at the surface layer were high after the tempering step but before the shot peening. As a result, the amount of the residual austenite was excessive, whereby the maximum compressive residual stress at the surface layer was low. In the comparative example of the sample No. 10, the temperature was high in the chemical surface treatment step, whereby the absorbed amounts of nitrogen and carbon were small, and the amount of residual austenite was small. As a result, the compressive residual stress layer was thin, and the maximum compressive residual stress was small. In the comparative example of the sample No. 11, the concentration of $NH_3$ in the atmosphere gas was zero in the chemical surface treatment step, and nitrogen and carbon were not absorbed. Accordingly, the compressive residual stress layer was thin, and the maximum compressive residual stress was small.

As described above, according to the present invention, the nitrogen compound layer and the carbon compound layer did not exist at the surface, and a high compressive residual stress layer with compressive residual stress of not less than 1400 MPa was thickly formed. Therefore, the fatigue strength was further improved.

INDUSTRIAL APPLICABILITY

The present invention can be widely applied for valve springs and suspension springs for automobiles and springs for uses other than in automobiles.

The invention claimed is:

1. A spring consisting of, by weight %, 0.27% to 0.48% of C, 0.01% to 2.2% of Si, 0.30% to 1.0% of Mn, not more than 0.035% of P, not more than 0.035% of S, and the balance of Fe, infiltrated N and inevitable impurities, the spring comprising:

a surface with a nitrogen compound layer and a carbon compound layer, the nitrogen compound layer and the carbon compound layer having a total thickness of not more than 2 μm, a center portion with a hardness of 500 HV to 700 HV in a cross section, and a compressive residual stress layer at a surface layer, the compressive residual stress layer having a thickness of 0.30 mm to D/4, in which D (mm) is a circle-equivalent diameter of the cross section, and has maximum compressive residual stress of 1400 MPa to 2000 MPa.

2. The spring according to claim 1, wherein compressive residual stress at a position of 300 μm depth from the surface is 100 MPa to 300 MPa.

3. The spring according to claim 1, wherein the cross section of the spring has a circle-equivalent diameter of 1.5 mm to 5.0 mm.

4. A production method for a spring, comprising, in this order:

a step of preparing a steel material consisting of, by weight %, 0.27% to 0.48% of C, 0.01% to 2.2% of Si, 0.30% to 1.0% of Mn, not more than 0.035% of P, not more than 0.035% of S, and the balance of Fe and inevitable impurities;

a chemical surface treatment step of heating the steel material at a temperature of not less than the $A_3$ point of the steel material and not more than 1100° C. and bringing the steel material into contact with a mixed gas atmosphere so as to concentrate nitrogen and carbon at a surface layer thereof, the mixed gas atmosphere consisting of 50 vol. % to 90 vol. % of $NH_3$ and the balance of inert gas and inevitable impurities at the standard condition of 1 atmosphere and 20° C.;

a step of quenching the steel material to room temperature at a rate of not less than 20° C./second;

a step of tempering the steel material at a temperature of 100° C. to 200° C.; and a step of providing compressive residual stress to the surface layer.

5. The production method for the spring according to claim 4, wherein the heating is performed at a temperature of 850° C. to 1000° C. for 15 minutes to 110 minutes in the chemical surface treatment step.

6. The production method for the spring according to claim 4, wherein the concentration of $NH_3$ in the mixed gas atmosphere is 80 vol. % to 90 vol. % in the chemical surface treatment step.

7. The production method for the spring according to claim 4, wherein the step of providing compressive residual stress is performed by shot peening.

8. The production method for the spring according to claim 4, wherein the step of providing compressive residual stress is performed by shot peening using shot with a sphere-equivalent diameter of 0.7 mm to 1.3 mm.

9. The production method for the spring according to claim 4, wherein the steel material contains residual austenite from a surface to 100 μm depth in a cross section at an average ratio of 10 vol. % to 35 vol. % after the step of tempering but before the step of providing compressive residual stress.

10. The production method for the spring according to claim 4, wherein the steel material contains carbon and nitrogen from a surface to 100 μm depth in a cross section at a total concentration of 0.8 weight % to 1.2 weight % after the step of tempering but before the step of providing compressive residual stress.

* * * * *